US005402992A

United States Patent [19]

Saxena

[11] Patent Number: 5,402,992

[45] Date of Patent: Apr. 4, 1995

[54] APPARATUS FOR PRODUCTION OF METAL GRANULES

[75] Inventor: Surendra K. Saxena, Trondheim, Norway

[73] Assignee: Norsk Hydro a.s., Oslo, Norway

[21] Appl. No.: 186,022

[22] Filed: Jan. 25, 1994

Related U.S. Application Data

[62] Division of Ser. No. 109,055, Aug. 19, 1993.

[30] Foreign Application Priority Data

May 14, 1993 [NO] Norway ..... 931784

[51] Int. Cl.[6] ..... B22D 21/04

[52] U.S. Cl. ..... 266/202; 222/594; 222/603; 164/437

[58] Field of Search ..... 266/202; 222/594, 603; 164/437

[56] References Cited

U.S. PATENT DOCUMENTS 3,695,795 10/1972 Jossick ..... 266/202
4,471,831 9/1984 Ray ..... 164/437

FOREIGN PATENT DOCUMENTS 1224125 9/1966 Germany ..... 75/333
2240553 8/1991 United Kingdom .
393317 12/1973 U.S.S.R. ..... 266/202
1246487 6/1991 U.S.S.R. ..... 75/340

*Primary Examiner*—George Wyszomierski
*Attorney, Agent, or Firm*—Wenderoth, Lind & Ponack

[57] ABSTRACT

Reactive metal granules, especially of magnesium and/or magnesium alloys, are produced directly from molten metal. The metal is fed under pressure to a granulation nozzle which forces the metal to acquire a circular motion of increasing velocity before it reaches the outlet of the nozzle and disintegrates successively into small fragments and droplets. These fragments and droplets are formed in an inactive gas atmosphere in an enclosed system and are thereafter solidified and cooled in a nonoxidizing cooling bath. An apparatus includes a granulation chamber made up of two parts which can be fitted to each other at various positions with an air tight locking system.

12 Claims, 2 Drawing Sheets

APPARATUS FOR PRODUCTION OF METAL GRANULES

This is a divisional application of Ser. No. 08/109,055, filed Aug. 19, 1993.

BACKGROUND OF THE INVENTION

The present invention relates to an apparatus for the production of particles/granules of reactive metals, particularly of magnesium and magnesium alloys, having an extremely high oxygen affinity and an appreciable vapor pressure at normal granulation temperatures. However the apparatus is suitable for the production of granules of all reactive metals having a certain vapor pressure, for example aluminum, zinc and calcium.

STATE OF THE ART

There are a number of known methods for production of metal particles. Depending upon the end use and particle size of the final product, the methods can be described under two main categories:

I Atomization Process

By this process, powder of a reactive metal is produced by atomization of a molten metal stream with an atomizing agent such as an inert gas or a liquid at high pressure. The atomizing agent, through special nozzles around the metal stream, hits the metal with such a high pressure that the whole metal stream, from the surface thereof to the center thereof, is disintegrated into fine fragments. Consequently, atomization methods always result in extremely fine metal particles of various size-fractions, but usually all the particles are less than 0.350 mm in size.

Production of reactive metal powders through atomization creates several problems. A large amount of inert gas, argon and/or helium, is required for the atomization and makes the product very expensive for common use. Also, because of vapor pressures of reactive metals like magnesium, the atomization process results in a large quantity of pyrophoric material, which is very difficult to handle. In addition reactive metals like magnesium and calcium react with oxygen, sulphur and water vapor/OH-molecules and other impurities present in the atomizing reagent, even in low concentrations, and cause problems. When a liquid atomizing agent is used, the resultant metal particles are of irregular shape/form which is suitable in powder metallurgy for the production of powder-sintered and/or powder forged articles. Such powders however, have very poor flowability and create problems in processes based on powder injection technology.

The atomization processes are limited to the production of small quantities of metal powders because of the fact that the production rate depends on the diameter of the metal stream which usually is small. As such, the complete disintegration of a relatively thick metal stream into extremely fine fragments through atomization is very difficult and can create dangerous conditions. In practice, when surface area per unit volume or surface properties of a metal powder are of great importance, the powder is produced through the atomization process.

Granulation Processes

Conventional methods and apparatus for the production of granules of reactive metal and/or metal alloys produce relatively large particles, mostly in a size range of 0.2–1.0 mm and containing about 90% above 0.5 mm.

Such methods can produce metal particles or metal granules even in larger size ranges, but the apparatus becomes highly voluminous.

In conventional methods, the molten metal stream (such as magnesium) is fed vertically down to a nozzle placed at the top of a granulation chamber. The nozzle disintegrates the stream into several small droplets which solidify as metal granules in an inert atmosphere of helium or argon (in the case of magnesium) in the granulation chamber. Because of the fact that the metal droplets are cooled in an inert gas having normally very poor cooling properties, the granulation chambers are rather tall. Otherwise the liquid droplet, if not completely solidified, would not be able to sustain the impact of falling the bottom of the chamber. It is known that a magnesium droplet up to 1 mm diameter requires a granulation chamber being about 7 meters tall, which is usually inconvenient. This problem can be severe during the production of large size metal granules. Magnesium droplets of 2 mm diameter would require a chamber of about 21 meter height.

To overcome this problem, an apparatus has been developed where the molten magnesium is pushed upwards through the nozzle, this is described in British patent application No. 2,240,553. This results in that the nozzle disintegrates metal droplets upwardly into a chamber. The net result is that the droplets follow a much longer path before reaching the bottom of the granulation tank. Consequently, height of the chamber can be somewhat reduced. However, in the production of relatively large size magnesium metal granules, coarser than 1.0 mm, even the chamber based on this method would be inconveniently high.

Use of inert gas as a cooling medium permits metal droplets to aquire a spherical shape, due to a surface tension effect. The spherical granules of reactive metal having the least surface area per unit volume have very good flow properties and are desired in processes based om powder injection. However, use of such a material in powder metallurgy or in processes where compression forces are applied has a disadvantage that the product exhibits poor cold formability and thus results in sintered articles of relatively low strength.

Use of inert gas as a cooling medium give rise to the following additional problems:

1. Since practically all inert gases have low specific heat and density, such gases are needed in large amounts which is considerably more expensive.
2. During the production of magnesium or magnesium alloy granules which exhibit magnesium vapor pressure at granulation temperatures, use of an inert gas results in enhanced diffusion of magnesium metal. This is because the partial pressure of magnesium in the inert gas is practically zero. This thus ultimately results in excessive magnesium vaporization which in abscence of necessary oxygen forms pyrophoric magnesium which is extremely dangerous and requires stringent handling conditions.
3. Practically all the inert gases contain some oxygen as an impurity. Normally this oxygen does not cause any noticeable problem. However, since an extremely large quantity of inert gas is required as a coolant in the conventional reactive metal granules production process, a considerably greater quantity of oxygen from the oxygen impurity of the inert gas comes in contact with the reactive molten metal. Based on experiments made in the course of the production of magnesium granules from molten metal, it has been observed that such oxygen reacts with liquid magnesium in the vicinity of the granulation nozzle and disturbs the outcoming liquid magnesium stream. If the nozzle opening is small, the above mentioned oxidation reaction can practically constrict the nozzle opening so badly that it becomes necessary to terminate the granulation process.

SUMMARY OF THE INVENTION

The object of the invention is to provide an apparatus for inexpensively mass producing on an industrial scale reactive metal granules, particularly of magnesium and magnesium alloys, alleviating most of the above mentioned limitations of the prior art reactive metal granulation process.

This and other objects of the invention are obtained with the apparatus described below.

Reactive metal granules, especially of magnesium and/or magnesium alloys, are produced directly from molten metal. The metal is fed under pressure to a granulation nozzle which forces the metal to aquire a circular motion of increasing velocity before it reaches the outlet of the nozzle and disintegrates successively into small fragments and droplets. These fragments and droplets are formed in an inactive gas atmosphere in an enclosed system and are thereafter solidified and cooled in a nonoxidizing cooling bath in a granulation chamber. It is preferred to feed the metal to a granulation nozzle containing a swirl chamber where the metal enters tangentially and aquires gradually higher rotation before leaving the outlet in a hollow conical spray pattern.

The metal is fed to the nozzle at a pressure between 1.2–4 bar, preferably in a range of 1.5–3.5 bar. The temperature of the granulation nozzle is kept at 500°–850° C. during granulation. It is possible to vary the height of the enclosed system where liquid metal fragments and metal droplets are formed. It is preferred to use argon or helium as an inactive gas in the enclosed system. It is also possible to use another inert gas with extremely low oxygen and/or vapor concentration. The pressure in the enclosed system is preferably maintained at about 1 atmosphere.

As the cooling bath it is preferred to use a non-polar oil, especially a mineral oil. The cooling bath is continuously stirred during granulation and is maintained at 5°–200° C. A certain quantity of the coolant is taken out from the bath, cooled externally and fed back into a lower part of the chamber via oil injection nozzles. It is preferred to spray the walls of the upper part of the granulation chamber before and after the granulation process with a non-oxidizing and inert cooling medium, preferably oil.

The apparatus according to the invention comprises a granulation chamber made up of two circular tanks, i.e. a lower tank and an inverted tank at the top having a bit smaller diameter than the lower tank so that the top tank can move up and down inside the lower outer tank. The two tanks are constructed in such a manner that they can be fitted with each other at several positions via an air tight locking system. Thus height of the granulation chamber can be adjusted to a desired level. The granulation chamber is made for keeping a cooling bath and is fitted with injection nozzles for stirring and cooling of the bath. There are arranged nozzles for spraying liquid onto the walls in the upper part of the chamber so as to avoid adherence thereto of any pyrophoric magnesium.

It is preferred to use a granulation nozzle which has an inverted more or less conical swirl chamber with a largest diameter in alignment with a nozzle inlet that is a tangential inlet to the swirl chamber. The nozzle chamber is enclosed by a preheating device and an additional device for closing and opening the passage between the nozzle and the granulation chamber.

DESCRIPTION OF THE DRAWINGS

The invention is further described below and exemplified with reference to the accompanying drawings, wherein.

DETAILED DESCRIPTION OF THE INVENTION

Figure 1:
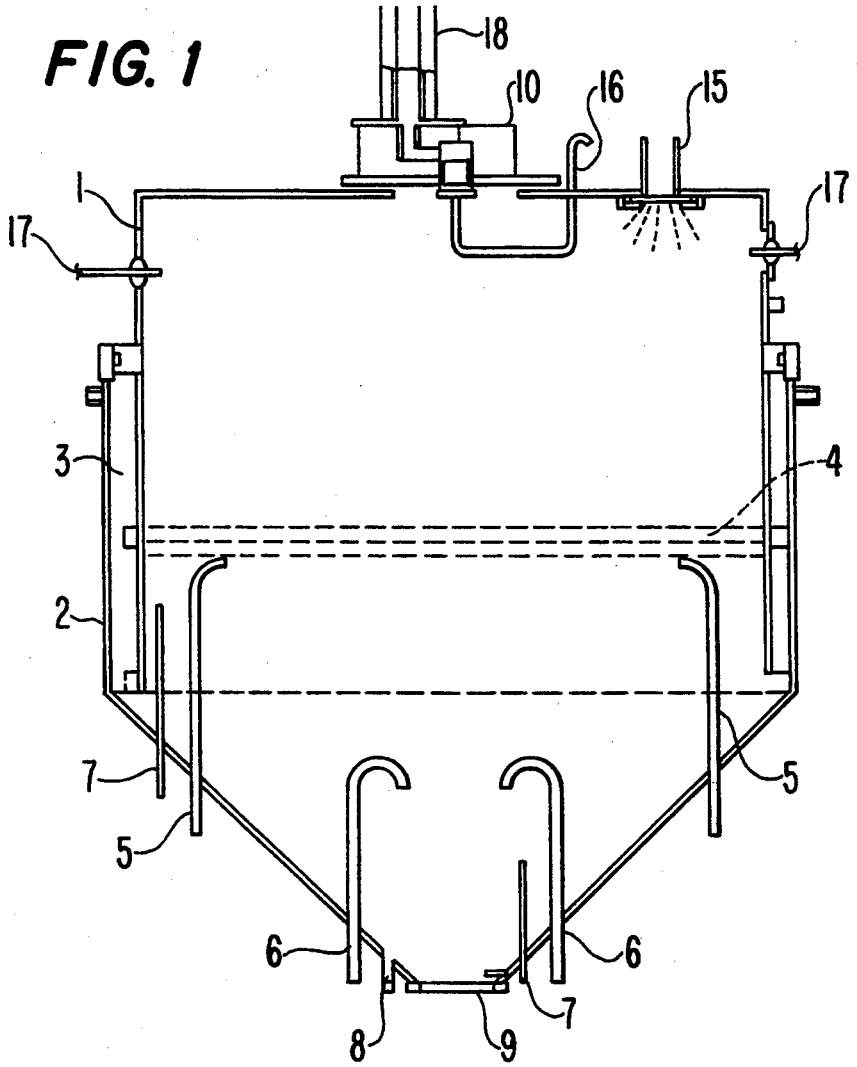
FIG. 1 is an elevational sectional view of a granulation chamber.

FIG. 1 shows an apparatus according to the invention comprising a granulation chamber made up of two circular tanks, i.e. an inverted tank 1 at the top and a lower outer tank 2. The upper tank can be raised and lowered inside the lower tank. The two tanks are constructed in such a manner that they can be fitted with each other at several positions via an air tight locking system 3. Thus, the height of the granulation chamber can be adjusted to a desired level. The chamber can be water/oil-cooled from all sides. The granulation chamber is partly filled with a predetermined quantity of oil 4. By changing position of the upper tank inside the lower tank and by filling a desired amount of oil into the granulation chamber, the height of the space above the oil bath can be regulated to a desired level.

There are a number of oil injection nozzles 5 fitted in a circular arrangement for stirring/agitating and cooling of the oil bath in the lower tank 2. The nozzles can be moved up and down and can also be rotated so as to fix them at specific angels as well as positions in the oil bath. The injection nozzles, if desired, can be fitted in the top or side wall of the upper tank. In the lower part of the lower tank 2, there are fitted a few oil outlet tubes 6, temperature measurement tubes 7, a granules sampling tube arrangement 8 and a slide valve arrangement 9 for complete removal of contents from the lower tank.

During the metal granulation process a predetermined amount of oil is removed from the oil outlets 6. Such removed oil is cooled in a cooler down to a desired temperature and is then pumped back into the granulation chamber through the oil injection nozzles 5. The temperature of the oil in the lower part of the chamber can be maintained 5°–200° C. The oil used is a nonpolar oil, preferably a mineral oil having good cooling properties. It could also be possible to use other nonpolar cooling liquid which is inert to the metal.

Figure 2:
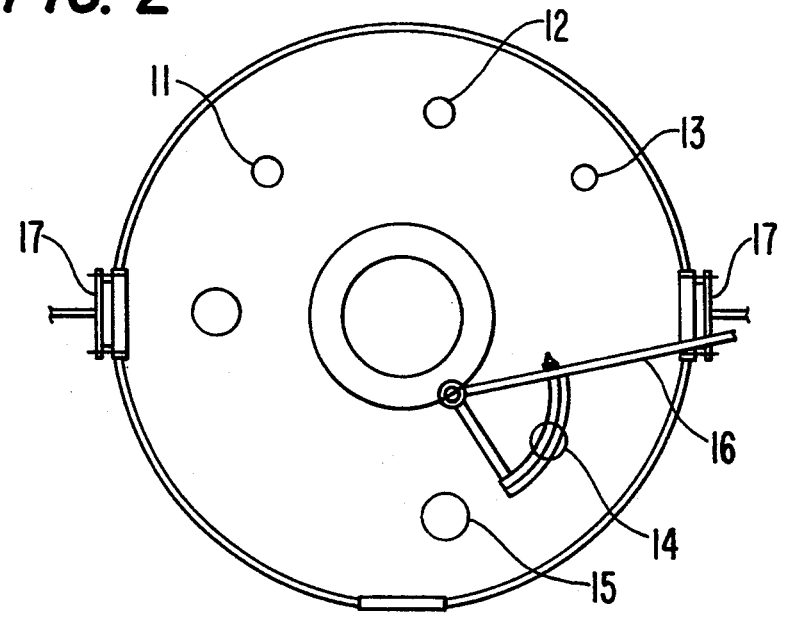
FIG. 2 is a top plan of an upper tank of the granulation chamber.

At the center top of the upper tank there is an opening for placing an arrangement containing a granulation nozzle 10 at the center. The nozzle is fixed at its place with an air tight arrangement. All around the nozzle arrangement there are a number of openings in the upper tank for a pressure sensor 11, an oil level control 12, an argon inlet valve 13, an overpressure valve 14, a view glass 15, etc. This is best seen in FIG. 2. The nozzle chamber can be closed and opened as desired through a locking system 16 operable from the top of the upper tank.

In a side wall of the inverted upper tank 1, at the top thereof, are fitted a few nozzles 17 for spraying oil on the inner surface of the chamber/tank so as to avoid adherence of eventual pyrophoric magnesium to the wall. Before opening the granulation chamber after reactive metal granules have been produced, the oil spraying operation is repeated for sacifying the pyrophoric magnesium. Consequently, the danger due to presence of eventual pyrophoric magnesium in the present invention is practically eliminated.

The nozzle arrangement 10 receives the molten reactive metal like magnesium through a preheated conduit 18. Before start of the metal granulation, the oil is filled into the granulation chamber to a predetermined level so that the space remaining between the nozzle arrangement and the oil bath is sufficient to convert dispersed reactive metal fragments from the granulation nozzle into spherical droplets. Thereafter, oil is sprayed onto the inner wall of the upper tank, and finally the closed space between the oil bath and the granulation nozzle is filled with argon gas in such a manner that such space acquires practically an oxygen free atmosphere at one atmosphere pressure. Once this is done, no additional argon or other inert gas is added to the upper part of the chamber during the course of the magnesium granulation process. The overpressure valve 14 in the upper tank controls automatically that the pressure is always maintained at one atmosphere. A pressure below atmospheric pressure (partial vacuum) would be favorable for formation of the metal droplets in the open space of the upper tank. This, however, on the other hand would enhance vaporization of the reactive metals, particularly magnesium, in the open space and thus formation of pyrophoric magnesium in the upper part of the chamber, which is undesirable. Use of a pressure above one atmosphere is of no value as long as oxygen concentration in the space is maintained at a low level. Higher pressure on the contrary would be a disadvantage to the formation of metal droplets as it would decrease rotation speed of the magnesium metal in the granulation nozzle.

By regulating the quantity of oil into and out of the granulation chamber, the height of the open space in the top of the granulation chamber can be adjusted at any time during the metal granulation process. By controlling temperature of the oil injected through the nozzles into the chamber and height of the oil bath in the chamber, it is possible according to the present invention to control at which stage and at which rate the metal droplets are to be cooled. This is in contrast to the prior art where it is necessary to solidify the metal droplets completely in argon, which requires an enormous quantity of argon gas and an inconveniently tall granulation chamber. The present invention requires practically a fixed small quantity of argon and/or other noble gas in the space needed for transforming the metal fragments into spherical droplets. In fact, only a limited portion of the granulation chamber used in the prior art is used for transforming reactive metal fragments into spherical droplets. A major height is used in cooling the droplets. The operation of cooling of the droplets in the present invention takes place fully in the oil bath, which has relatively much better cooling properties. Consequently, the height of the cooling chamber in the apparatus of the present invention is considerably smaller than in the prior are, even when magnesium granules of relatively coarse size are produced, e.g. $>1.0$ mm.

Operation of the apparatus according to the present invention can produce reactive metal granules, particularly of magnesium, in shapes varying from irregular to practically spherical by adjusting the distance between the granulation nozzle and the oil bath, and to an extent by controlling temperature as well as amount of oil input through nozzles in the upper zone of the oil bath. The method and apparatus in the prior art on the contrary produce metal particles of only one shape, whereas the present invention is more flexible.

Magnesium metal granulation under such conditions produces more or less spherical particles, as the metal droplets during falling in the oil bath become somewhat deformed. However, such magnesium granules have good flow properties and can be used easily in a powder injection process.

For obtaining irregular shape granules, the height of the space above the oil bath would have to be reduced so as to avoid complete adjustment of the dispersed metal fragments into spherical droplets. This procedure results in magnesium granules having irregular shapes. The present invention can also produce magnesium granules which have relatively high surface area and reasonably good flow properties by increasing the height of the space above the oil bath more than that required for obtaining spherical metal droplets. In such case, the spherical droplets hit the oil bath with a greater impact and thus are deformed to a higher degree.

Figure 3A:
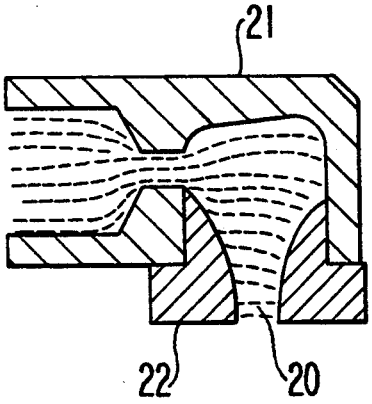
FIG. 3A and 3B are a vertical sectional view and a horizontal sectional view, respectively, of an upper portion of a granulation nozzle.
Figure 3B:
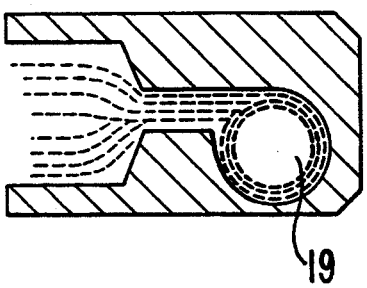

FIGS. 3A and 3B show details of the granulation nozzle of the present invention. The important point with this nozzle is that the liquid metal is forced to acquire a rapid circular flow pattern or a rapid rotation before it is discharged. This is achieved by directing the liquid at various pressures at the periphery of a hollow conical chamber 19 at the upper part of the nozzle, see FIG. 3B. The liquid metal thereafter flows, maintaining its rapid circular flowpattern, downwards in an unobstructed passage 20 which gradually decreases in size to a smaller diameter. The nozzle works satisfactorily when the ratio of inlet and outlet opening areas is in a range between 0.4–1.5. The condition is that the reactive metal pressure, for example magnesium, at the inlet is a minimum of 1.2 bar. The most desirable liquid metal pressure lies in the range between 1.4 to 4.5 bar. The nozzle is made up of two numbers or parts, i.e. an upper part 21 and a lower part 22. If required, it is possible to change the lower part to adjust to an another ratio between the inlet and outlet openings area of the nozzle. Although such a nozzle construction has been known for water spraying under pressure, such construction has not been known to work satisfactorily in the granulation of reactive metals. Surprisingly, it has been observed that in the apparatus according to the present invention where concentration of oxygen as well as the amount of oxygen in the atmosphere below the nozzle during the course of the metal granulation process is so extremely small, such nozzle construction works without any problem. Major advantages of such nozzle construction over that used in the prior art are:

1. Relatively small pressure drop in the nozzle.
2. Unobstructed flow passage which minimizes or practically eliminates the problem of clogging.
3. Relatively high metal granulation capacity.
4. More flexible in operation and simple in construction and consequently relatively inexpensive.

Although, the nozzle shown in FIGS. 3A and 3B has an inlet at the side, one can obtain also similar granulation results with an identical nozzle with an inlet at the top.

When finishing the metal granulation process, it is possible to freeze metal in the nozzle. After the pressure to the nozzle has come down to about 0.5 bar, a large amount of cold argon is blown over the granulation nozzle to freeze the metal therein. In this way magnesium is retained in the transport tube and oxidation of the metal is prevented.

The apparatus has been described based on a batch process. However, by using a number of metal granulation nozzles on the top portion of the upper part of the granulation chamber and by providing two or more outlets with exit valves for removing the granules continuously out of the chamber during the granulation process, the metal granulation process would run as a continuous process. One way to remove the metal granules from the chamber is to attach two or more containers filled with oil to the outlets of the lower tank. On opening of exit valves of the lower tank, the metal granules would be filled into the containers without effecting the top oil level of the granulation chamber. The containers thereafter are opened one by one to remove the metal granules and then are refilled with oil.

To remove the oil from the metal particles, these could be centrifuged and further treated as described in Norwegian patent application No.912,548.

EXAMPLE

Experiments were carried out using a granulation chamber as shown in the drawings for the production of magnesium particles. The distance between the nozzle and the oil level in the granulation chamber was about 80 cm. The experimental conditions as well as the results are shown in table 1.

TABLE 1

| Trial No. | Nozzle diam.mm | Temp °C. | Furnace Pressure bar | Production of Magnesium granules liter/min | kg/min |
|---|---|---|---|---|---|
| I | 3.2 | 700–715 | 1.45 | 2.77 | 1.94 |
| II | 4.0 | 680–700 | 1.6 | 7.41 | 5.19 |

In table 2 a size analysis of the product is given.

TABLE 2

| | −0.3 mm | +0.3–1.0 mm | +1.0–2.0 mm | +2.0mm |
|---|---|---|---|---|
| Trial I | 0.2% | 43.4% | 48.8% | ca. 7.6% |
| Trial II | 2.8% | 50.8% | 34% | 12.4% |

As can be seen from the granules obtained in trial I, the liquid magnesium became completely granulated with the nozzle at a pressure of 1.45 bar. With a larger nozzle in trial II having a diameter of 4 mm, the furnace pressure of 1.6 bar was not enough to cause complete granulation. The distance between the nozzle and the oil bath in this trial was 170 mm shorter than that in the first trial, and the shape of the particles between 1–2.0 mm and coarser than 2.0 was more or less irregular and was far from round. To obtain spherical particles identical to that in the first trial with such a nozzle diameter, the distance between the nozzle and oil bath should be increased.

However, the results do prove that is possible to produce pure magnesium granules as well as irregular particles directly from molten metal. The liquid metal is, however, to be supplied to the granulation nozzle at high pressure.

By this invention, there is obtained a flexible process where it is possible to produce particles/granules of reactive metals of different sizes and shapes. A rapid cooling is obtained, and the height of the granulation chamber can be drastically reduced. The particles are oxide free, and pyrophoric magnesium particles are avoided.

I claim:

1. An apparatus for producing metal granules from molten metal, said apparatus comprising:

a granulation chamber to contain in a lower part thereof a cooling bath and in an upper part thereof a gaseous atmosphere above the cooling bath, said granulation chamber being defined by an upper tank and a lower tank adjustable in height relative to each other by a locking system;

a granulation nozzle mounted on said upper tank to discharge molten metal as successively disintegrated fragments into the gaseous atmosphere in said upper part of said granulation chamber, whereby the fragments form into molten metal droplets in the gaseous atmosphere, and then the droplets are cooled and solidified into metal granules in the cooling bath in said lower part of said granulation chamber;

at least one injection nozzle mounted on said lower tank for stirring and cooling the cooling bath in said lower part of said granulation chamber; and at least one spray nozzle mounted on said upper tank for spraying inner walls of said granulation chamber with a liquid.

2. An apparatus as claimed in claim 1, wherein the molten metal is a reactive metal, the gaseous atmosphere is inactive to the reactive metal, the cooling bath is a non-oxidizing liquid, and said locking system is operable to lock said upper and lower tanks air tightly relative to each other.

3. An apparatus as claimed in claim 1, wherein said granulation nozzle includes a nozzle chamber having an inlet, an outlet and a size that decreases downwardly from said inlet to said outlet.

4. An apparatus as claimed in claim 3, wherein said inlet opens tangentially into said nozzle chamber.

5. An apparatus as claimed in claim 3, wherein said nozzle chamber has approximately a conical configuration.

6. An apparatus as claimed in claim 3, wherein said nozzle chamber has a diameter that is largest in alignment with said inlet.

7. An apparatus as claimed in claim 3, wherein a ratio of cross-sectional areas of said inlet and said outlet is 0.4 to 1.5.

8. An apparatus as claimed in claim 3, wherein said granulation nozzle is formed of two separable members including a first member defining said inlet and an upper portion of said nozzle chamber and a second member defining said outlet and a lower portion of said nozzle chamber.

9. An apparatus as claimed in claim 1, comprising plural injection nozzles mounted on said lower tank.

10. An apparatus as claimed in claim 9, wherein said injection nozzles are adjustable vertically and rotatably.

11. An apparatus as claimed in claim 1, comprising plural spray nozzles mounted on said upper tank.

12. An apparatus as claimed in claim 1, wherein said granulation nozzle includes an outlet to discharge molten metal fragments, and further comprising an opening and closing device mounted on said upper tank to selectively open and close said outlet.

* * * * *